United States Patent [19]

Allen

[11] Patent Number: 5,050,996

[45] Date of Patent: Sep. 24, 1991

[54] PAINT SHAKER APPARATUS POWERED BY A PNEUMATIC SANDING TOOL

[76] Inventor: Michael W. Allen, 1387 New Hope Rd., Lawrenceville, Ga. 30245

[21] Appl. No.: 557,374

[22] Filed: Jul. 24, 1990

[51] Int. Cl.[5] ..... B01F 11/00; B01F 3/00

[52] U.S. Cl. ..... 366/211; 366/605; 366/237; 366/111

[58] Field of Search ..... 366/605, 208, 209, 210, 366/211, 216, 239, 219, 279, 65, 64, 212, 213, 214, 215, 240, 34, 348, 349, 111; 248/678, 676

[56] References Cited

U.S. PATENT DOCUMENTS

| | | | |
|---|---|---|---|
| 2,224,806 | 12/1940 | Benson | 366/279 |
| 2,846,201 | 8/1958 | Mermelstein | 366/110 |
| 3,030,082 | 4/1962 | Matzen | 366/209 |
| 3,154,294 | 10/1964 | Bittner | 366/208 |
| 3,301,534 | 1/1967 | Orser | 366/605 |
| 3,330,537 | 7/1967 | Wason | 366/114 |
| 4,398,829 | 8/1983 | Shick | 366/110 |
| 4,420,262 | 12/1983 | Sterrenberg | 366/110 |
| 4,662,760 | 5/1987 | Powell | 366/605 |
| 4,702,610 | 10/1987 | Reynolds | 366/209 |

FOREIGN PATENT DOCUMENTS

| | | | |
|---|---|---|---|
| 2941421 | 10/1979 | Fed. Rep. of Germany | 366/208 |
| 175995 | 7/1961 | Sweden | 366/208 |

*Primary Examiner*—Harvey C. Hornsby
*Assistant Examiner*—Terrence R. Till

[57] ABSTRACT

A paint shaker apparatus utilizing a typically hand held pneumatic random orbital sanding tool (14) as motor and crankshaft. A base housing (10) is adapted to receive and support a pneumatic random orbital sanding tool (14) with the sanding pad removed. The base housing (10) is adapted to be supported on a supporting surface and further includes a container cradle assembly (62) to receive and support a container to be shaken. The container cradle assembly (62) provides a clamp mechanism for holding a container to be shaken and is secured to a main shaft (40) rotatably mounted on the base housing (10) for oscillation about a vertical axis. A crank arm (44) is attached to the main shaft (40) and is connected to the sanding pad spindle (60) by a connecting rod (48).

4 Claims, 4 Drawing Sheets

PAINT SHAKER APPARATUS POWERED BY A PNEUMATIC SANDING TOOL

BACKGROUND-FIELD OF INVENTION

The present invention relates generally to an apparatus for shaking paint containers and the like, and more particularly, to an apparatus powered by a pneumatic sanding tool.

BACKGROUND-DESCRIPTION OF PRIOR ART

Modern metallic paints used by automotive body repair and paint shops often contain materials such as aluminum or mica flake which must be completely and thoroughly mixed before use. Numerous types of shaker devices (hereinafter referred to generally as paint shakers) that provide a highly energetic shaking motion of a container in order to mix the paint contained therein, are extensively used at the present time for this purpose.

Most repairs performed by automotive body repair and paint shops usually require the use of 1 liter or less paint to complete. However, most paint shakers are adapted for shaking 4 liter or 1 gallon containers and therefore are usually large, heavy machines that require a powerful motor to generate the shaking motion. While such paint shakers will accommodate 1 liter or smaller containers, these machines are generally expensive to purchase and may be cost prohibitive to smaller body repair and paint shops.

Less expensive paint shakers designed specifically for container sizes of 1 liter or less are generally limited to shaker devices utilized with or powered by various hand tools. Heretofore, such devices are not believed to possess the strength and powerful shaking motion needed to thoroughly agitate automotive paints.

U.S. Pat. No. 4,420,262 to Sterrenberg (1983) discloses a paint shaker, one illustrated embodiment of which is adapted to be driven by a hand held power drill. The disclosed paint shaker includes a base in the form of a cradle for receiving a paint container to be shaken. A pair of band clamps are attached to the base for securing the paint container therein. The base also provides a bearing housing for supporting a rotatably mounted drive shaft. A second drive shaft is engaged in the rotatable chuck of a hand held power drill.

The shaking device disclosed in the aforementioned patent is not believed to be well adapted for the purpose of shaking automotive paints. The paint container holding cradle is intended to receive relatively light weight containers of aerosol paint. In addition, the drive shaft is not believed to be of sufficient strength to withstand the highly energetic shaking motion needed to thoroughly shake a heavier bodied automotive paint. Furthermore, the aforementioned paint shaker would require the operator to hold the paint container, shaking device and power drill for a relatively long period of time during the shaking operation.

U.S. Pat. No. 4,398,829 to Shick (1983) discloses a paint shaker which is adapted to be driven by a vibrating power sander. The disclosed paint shaker consist of a plate for direct attachment to the vibratory sanding base of the power sander. An elastomeric strap is used to secure cans of various height to the plate for shaking.

The paint shaker disclosed in the aforementioned patent is designed as a direct attachment to the vibrating power sanders base, therefore the shaking motion is limited to that of the sanding tool to which it is attached. It is not believed that an attachment of this type would provide the highly energetic shaking motion needed to thoroughly agitate most paints. Furthermore, the aforementioned paint shaker would require being hand held by the operator until the shaking operation is completed.

OBJECTS AND ADVANTAGES

Accordingly, it is the principle object of the present invention:

(a) to provide a paint shaker which is admirably suited for shaking sealed containers of paint or the like of 1 liter or less in size.

(b) to provide a paint shaker which is highly energetic, powerful, of minimum bulk, and relatively inexpensive.

(c) to provide a paint shaker which is powered by a typically hand held pneumatic random orbital sanding tool utilizing the sanding tools eccentric driving head and rotatably mounted sanding pad spindle to impart a simple, torsional, oscillatory motion on an axis through the traverse centerline of a container being shaken.

(d) to provide a paint shaker designed to be powered by and readily accommodate a variety of designs of a typically hand held pneumatic random orbital sanding tool.

(e) to provide a paint shaker which is powered by a pneumatic random orbital sanding tool which can easily be installed or replaced by the owner.

(f) to provide a paint shaker powered by a pneumatic random orbital sanding tool that does not require the tool or the paint container to be hand held by the operator.

(g) to provide a paint shaker of the foregoing character for use where an electric powered machine would not be suitable.

Further objects and advantages of the present invention will become apparent from a consideration of the ensuing description and drawings.

DRAWING FIGURES

Reference Numerals In Drawings

Figure 1:
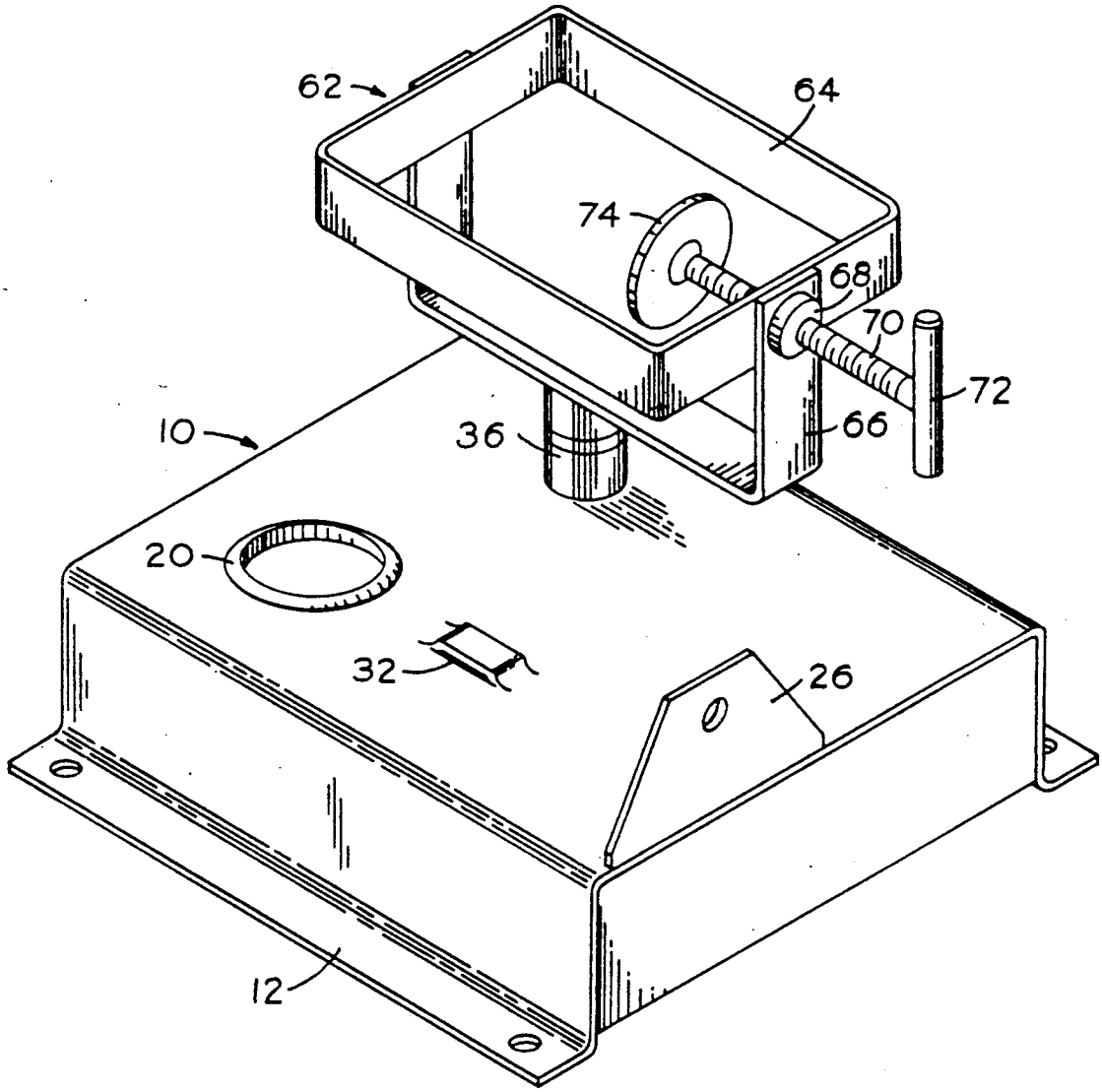
FIG. 1 is a perspective view of a paint shaker apparatus utilized in conjunction with a typically hand held pneumatic random orbital sanding tool.

| | | | |
|---|---|---|---|
| 10 | base housing | 12 | mounting flanges |
| 14 | random orbital sanding tool | 16 | eccentric driving head |
| 18 | container | 20 | resilient grommet |
| 22 | air motor housing | 24 | air inlet fitting |
| 26 | plate | 28 | handle |
| 30 | adjustable band clamp | 32 | slot |
| 34 | control valve lever | 36 | main shaft support |
| 38A | bearing | 38B | bearing |
| 40 | main shaft | 42 | shaft collar |
| 44 | crank arm | 46 | crank arm bolt assembly |
| 48 | connecting rod | 50 | rod bearing |
| 52 | spacer bushing | 54 | rod bolt |
| 56 | doubly piviotal bushing | 58 | spindle bolt |
| 60 | sanding pad spindle | 62 | container cradle |

-continued

| Reference Numerals In Drawings | |
|---|---|
| | assembly |
| 64 rectangular section | 66 U section |
| 68 threaded boss | 70 elongated bolt |
| 72 hand grip | 74 disc |
| 76 speed control valve | |

DESCRIPTION-FIGS. 1 TO 4

Figure 2:
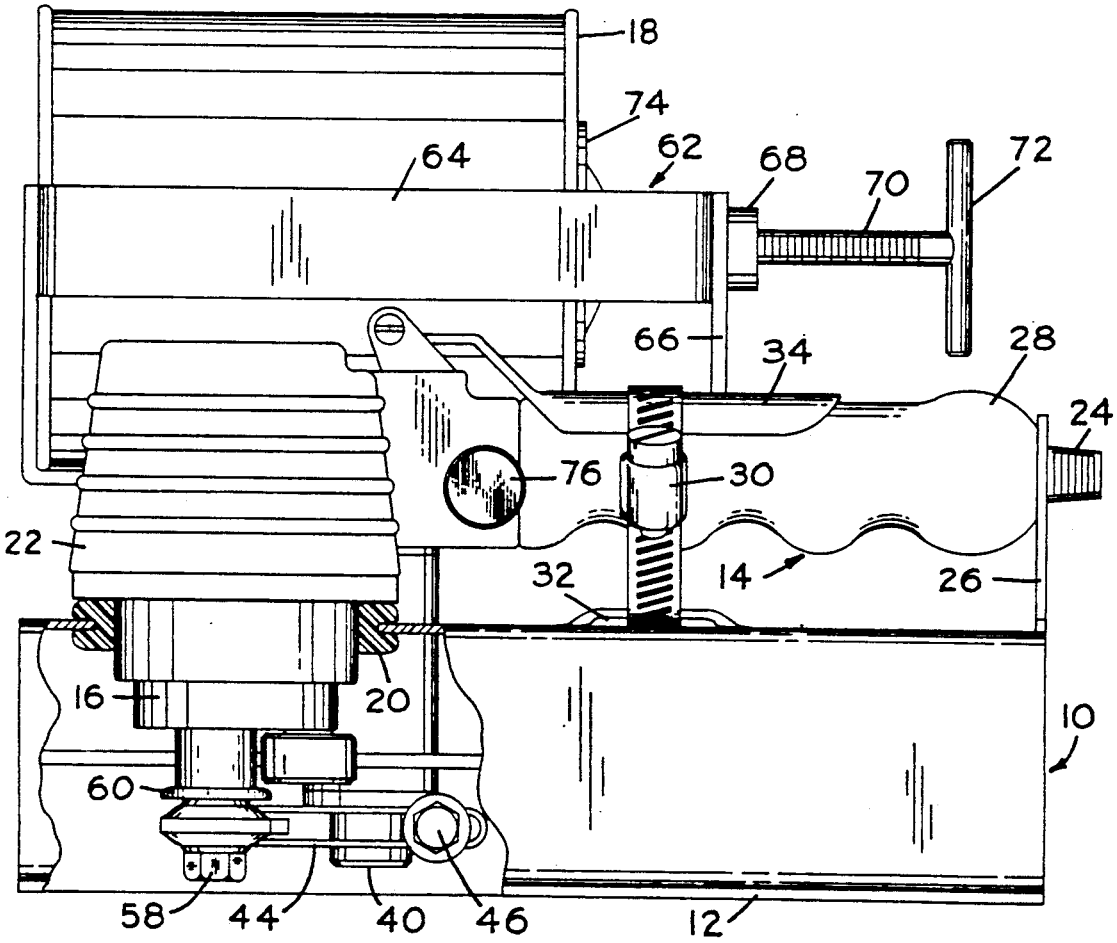
FIG. 2 is a side view of the paint shaker apparatus shown in FIG. 1 with a random orbital sanding tool mounted to the base housing with a portion of the base housing cut away showing the motive parts.
Figure 3:
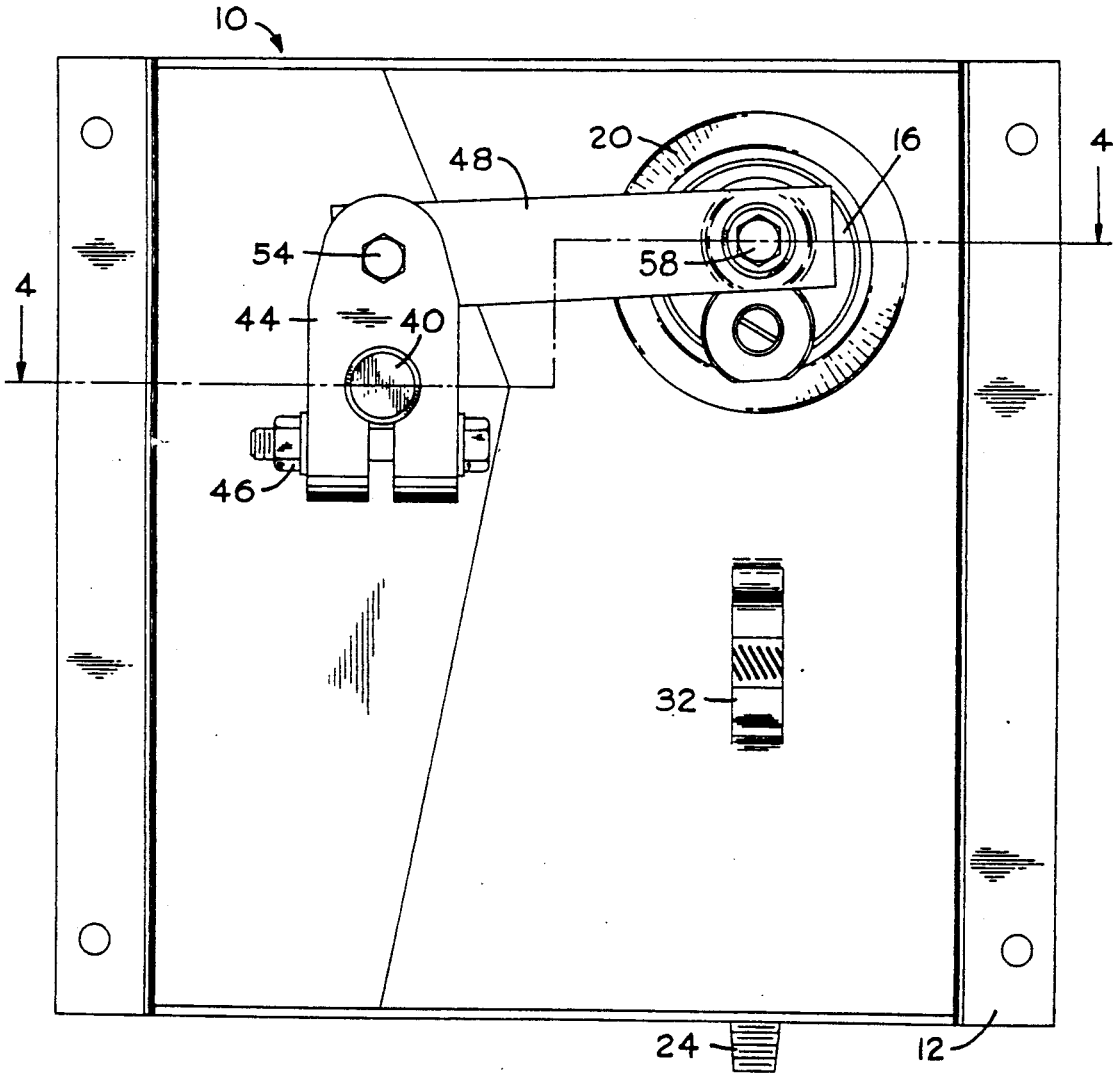
FIG. 3 is a bottom view of the paint shaker apparatus shown in FIGS. 1 and 2 showing the crank arm and connecting rod.
Figure 4:
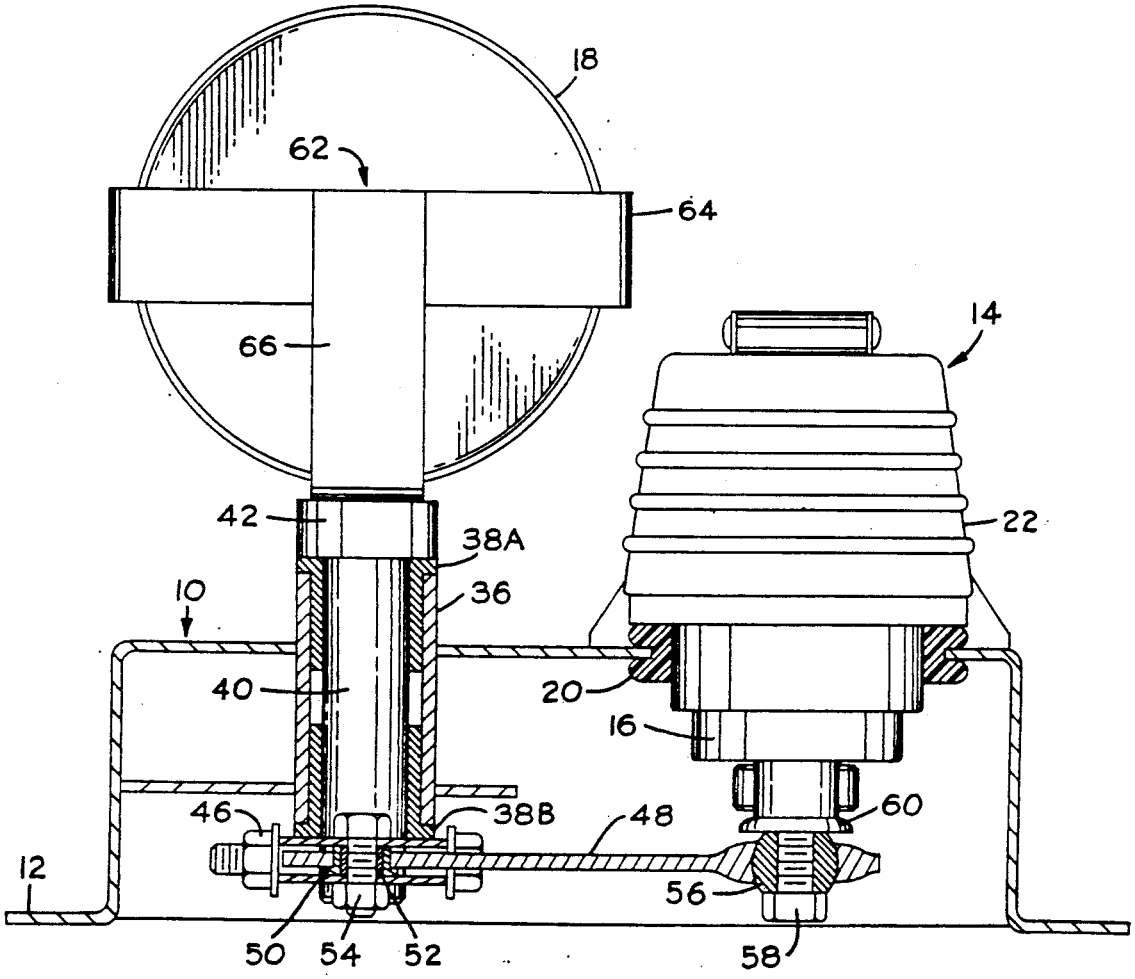
FIG. 4 is a cross sectional view taken through lines 4—4 as shown in FIG. 3.

As shown in FIGS. 1, 2, 3 and 4, the illustrated embodiment of the present invention defines a base housing 10 with mounting flanges 12 containing a plurality of holes for securely attaching the apparatus to a rigid support. Also included in base housing 10 are provisions to securely attach a typically hand held pneumatic random orbital sanding tool 14 thereto, utilizing the tools eccentric driving head 16 to impart a simple, torsional, oscillatory motion on an axis through the traverse centerline of a container 18 being shaken.

Referring to base housing 10 shown in FIGS. 1–4, eccentric driving head 16 passes through an opening allowing air motor housing 22 to be supported by resilient grommet 20. Handle 28 is supported by air inlet fitting 24 which passes through a hole provided in plate 26. Adjustable band clamp 30 passes through slot 32 punched in base housing 10, then around control valve lever 34 and handle 28. Simply tightening band clamp 30 securely attaches pneumatic random orbital sanding tool 14 to base housing 10.

Base housing 10 also includes main shaft support 36 containing bearings 38A–38B which rotatably support main shaft 40. Main shaft 40 is located axially vertically by shaft collar 42 suitably secured to the shafts upper end.

Crank arm 44 is clamped rigidly to main shaft 40 by crank arm bolt assembly 46. One end of connecting rod 48 is attached to the outer end of crank arm 44 by rod end bearing 50, spacer bushing 52, and rod bolt 54. The opposite end of connecting rod 48 contains a doubly piviotal bushing 56 which is attached to sanding pad spindle 60 by spindle bolt 58.

The container cradle assembly 62 may be simply constructed of two sections of steel flat stock, section 64 being bent in the form of a rectangle, and section 66 being bent in the form of a U with parallel legs. U shaped section 66 forms the bottom of container cradle assembly 62 and is welded to collar 42. The legs of U shaped section 66 are welded or suitably secured to section 64. One end of container cradle assembly 62 is provided with an internally threaded boss 68 extending therethrough to accommodate an elongated bolt 70 having a hand grip 72 on the outer end thereof by which the bolt may be adjusted. The inner end of elongated bolt 70 carries a disc 74 which is connected by a loose fit so that the disc 74 may properly locate itself when forced against a container 18 by the activation of elongated bolt 70.

From the description above, a number of advantages of my paint shaker apparatus become evident:

(a) The present invention is powered by a relatively inexpensive pneumatic random orbital sanding tool known by those skilled in the art to be both powerful and durable.

(b) The base housing will accommodate a variety of manufacturers designs of pneumatic random orbital sanding tool.

(c) The pneumatic random orbital sanding tool can be easily installed or replaced by the owner.

(d) When powered by a pneumatic random orbital sanding tool, the present invention provides the powerful, highly energetic, shaking motion needed to thoroughly agitate automotive paints.

(e) Utilization of a pneumatic random orbital sanding tool as motor allows the present invention to be used in areas where an electric powered machine would not be suitable.

(f) The present invention does not require the apparatus, sanding tool, or container to be hand held by the operator.

(g) The container cradle assembly is admirably suited for 1 liter or smaller containers of paint that are normally used in most automotive body repair and paint shops.

Operation

In operation, the present invention is extremely simple. A pneumatic random orbital sanding tool 14 with sanding pad removed, is firmly attached to base housing 10 in the manner previously described. Connecting rod 48 is attached to sanding pad spindle 60 and secured by spindle bolt 58.

With the sanding tool installed, the present invention is firmly attached to a supporting surface utilizing mounting flanges 12 provided by base member 10. A container 18 to be shaken is placed in container cradle assembly 62, the operator twirls hand grip 72 thereby moving elongated bolt 70 to clamp disc 74 against one end of the container. This will tightly hold the container in position against the bottom of rectangular section 64 of container cradle assembly 62. Disc 74 should press against the lid of the container to maintain the same tightly closed. A source of compressed air is attached to air inlet fitting 24. Control valve lever 34 is held in the open position by the action of adjustable band clamp 30 therefore, to energize the sanding tool, the operator simply opens speed control valve 76 allowing compressed air to rotate the sanding tools air motor and eccentric driving head 16. The motion provided by eccentric driving head 16 is transferred to crank arm 44 through connecting rod 48 which moves crank arm 44 back and fourth through a short arc and hence main shaft 40 to which is attached container cradle assembly 62 and container 18 held therein. The oscillatory motion provided may be had at relatively high speed to insure thorough mixing of the containers contents.

Summary, Ramifications, and Scope

Thus the reader will see that the present invention provides a paint shaker apparatus of simple construction which is admirably suited for shaking containers of paint or the like of approximately 1 liter or less in size. Furthermore, the present invention has the additional advantages in that it is powered by a relatively inexpensive pneumatic random orbital sanding tool;

the base housing will accommodate a variety of manufacturers designs of pneumatic random orbital sanding tool;

the pneumatic random orbital sanding tool can be easily installed or replaced by the owner;

when powered by a pneumatic random orbital sanding tool, the present invention provides the powerful, highly energetic, shaking motion needed to thoroughly agitate automotive paints;

utilization of a pneumatic sanding tool as motor allows the present invention to be used in areas where an electric powered machine would not be suitable;

does not require the apparatus, sanding tool, or container to be hand held by the operator.

While my previous description contains many specificities, these should not be construed as limitations on the scope of the invention, but rather as an exemplification of one preferred embodiment thereof. Many other variations are possible. For example, the base housing and container cradle assembly could be manufactured of other materials such as aluminum alloys, thermosetting plastics such as fiberglass, thermoplastics, cast iron, or stainless steel. The container cradle assembly could be adapted to receive containers of a specific or unusual shape or size. The shape of the resilient grommet could be changed to accommodate the air motor housing of other designs of pneumatic random orbital sanding tool. Other methods to releasably secure the sanding tool to the base housing could be utilized. For example, manufacturers of pneumatic random orbital sanding tools could provide a plurality of threaded holes within the tools air motor housing. In this case, a corresponding plurality of holes could be provided within the base housing of the paint shaker apparatus. The sanding tool could then be releasably secured to the base housing merely by inserting screws within each of the plurality of holes formed within the base housing and threading the plurality of screws into the corresponding plurality of threaded holes provided in the sanding tools air motor housing. Also, manufacturers whose sanding tool includes an inclined sanding pad spindle, could provide an eccentric driving head with the axis of the sanding pad spindle parallel to the tools motorshaft. In this case, the doubly piviotal bushing provided in one end of the connecting rod could be eliminated.

Accordingly, the scope of the invention should be determined not by the embodiment illustrated, but by the appended claims and their legal equivalents.

I claim:

1. A paint shaker apparatus used in conjunction with a typically hand held pneumatic random orbital sanding tool, said paint shaker apparatus utilizing said pneumatic random orbital sanding tool as motor and crankshaft, said pneumatic random orbital sanding tool externally mounted and releasably attached to said paint shaker apparatus thereby allowing the tool to be quickly removed and operated normally when released from the apparatus, said pneumatic random orbital sanding tool of the type having a motor, a motor housing, an eccentric driving head, a rotatably mounted sanding pad spindle, and a handle, said paint shaker apparatus comprising:

a. a base housing;

b. attachment means for releasably attaching said pneumatic random orbital sanding tool to said base housing;

c. a vertical shaft having an upper and a lower end, the upper end projecting out of said base housing and extending thereabove, means rotatably mounting said vertical shaft on said base housing;

d. a container cradle assembly to receive a container to be shaken, means mounting said container cradle assembly to the upper end of said vertical shaft for oscillation about a vertical axis;

e. a crank arm having a first end and a second end, the first end secured to the lower end of said vertical shaft;

f. a connecting rod having a first end and a second end, the first end pivotally connected to the second end of said crank arm, the second end being secured to the sanding pad spindle of said pneumatic random orbital sanding tool.

2. A paint shaker apparatus as defined in claim 1 wherein said attachment means include:

a. a support plate attached to one end of said base housing and projecting vertically thereabove to support the handle of said pneumatic random orbital sanding tool;

b. an opening provided in the top of said base housing of suitable diameter as to allow the eccentric driving head and sanding pad spindle of said pneumatic random orbital sanding tool to pass therethrough thereby allowing attachment of said connecting rod to the sanding pad spindle;

c. a resilient grommet fitted within said opening of said base housing serving to locate and support the motor housing of said pneumatic random orbital sanding tool within said opening when the handle of the tool is supported in said support plate and said motor housing is vertically oriented and pressed into said opening;

d. a flexible strap including adjustment means, said flexible strap being secured to said base housing by insertion through a slot provided in the top of said base housing, said slot generally positioned adjacent to the handle of said pneumatic random orbital sanding tool, said flexible strap for tightening around the handle of the tool thereby exerting sufficient pressure to hold said motor housing into said opening;

e. securing means to secure the end of said connecting rod to the sanding pad spindle of said pneumatic random orbital sanding tool.

3. A paint shaker apparatus as defined in claim 1 wherein said container cradle assembly includes means to releasably secure a container to be shaken.

4. A paint shaker apparatus as defined in claim 1 wherein said connecting rod has a first end and a second end, the first end pivotally connected to said crank arm, the second end provided with a doubly pivotal bushing for attachment to the sanding pad spindle of said pneumatic random orbital sanding tool.

* * * * *